US006918518B2

(12) United States Patent
Blitz et al.

(10) Patent No.: US 6,918,518 B2
(45) Date of Patent: Jul. 19, 2005

(54) SIZER TAB AND HANGER COMBINATION

(76) Inventors: Leslie S. Blitz, 25 Campbell St., New Hyde Park, NY (US) 11040; Steve Bernstein, 1705 Hereford Rd., Hewlett, NY (US) 11557

( * ) Notice: Subject to any disclaimer, the term of this patent is extended or adjusted under 35 U.S.C. 154(b) by 0 days.

(21) Appl. No.: 10/428,684

(22) Filed: May 5, 2003

(65) Prior Publication Data

US 2004/0222251 A1 Nov. 11, 2004

(51) Int. Cl.[7] ..... A41D 27/22
(52) U.S. Cl. ..... 223/85
(58) Field of Search ..... 223/85; 40/322

(56) References Cited

U.S. PATENT DOCUMENTS 5,913,462 A * 6/1999 Petrou ..... 223/85

* cited by examiner

*Primary Examiner*—John J. Calvert
*Assistant Examiner*—James G Smith
(74) *Attorney, Agent, or Firm*—Levisohn, Berger & Langsam, LLP

(57) ABSTRACT

A locking sizer tab and garment hanger combination is provided in which locking fingers of the sizer tab cooperatively lock into respective cross-bars formed in the neck of the hanger to prevent removal of the sizer tab from the hanger.

10 Claims, 5 Drawing Sheets

SIZER TAB AND HANGER COMBINATION

BACKGROUND OF THE INVENTION

This invention relates to a sizer system for garment hangers, and more particularly, to a sizer tab which is very difficult to remove from the hanger to which it is attached.

Sizer tabs are placed preferably on the necks of hangers to provide a visible surface easily viewable carrying the printed size of the garment on the hanger. Sizer tabs, generally, are small plastic items.

There are a plurality of patents issued to sizer tabs: U.S. Pat. No. 5,096,101 to Norman, entitled Garment Hanger With Locking Information Tab; U.S. Pat. No. 6,189,746 to Gouldson, entitled Side Indicator Hangers and Method and Apparatus for Removing Indicators from Hangers; and U.S. Pat. No. 6,145,713 to Zuckerman, entitled Hanger with Irremovable Information Tab are three such examples. These patents are incorporated herein by reference. Each of these garment hanger/sizer tab combinations includes a physical barrier located on the neck of the hanger in front of the tab to try to prevent the sizer tab from being removed. The purpose of preventing such removal is to minimize possible injury to small children who might remove and swallow the tabs. Thus, these type sizer tabs are generically known as childproof.

As it happens, children's small fingers generally can get beyond the blocking barrier and reach the forward portions of the sizer tab to remove it from the hanger web.

An object of this invention is to provide an improved sizer tab which will substantially eliminate the possibility of being removed from the garment hanger.

Another object of this invention is to provide such a sizer tab which would be relatively similar in appearance and function to prior sizer tabs so as to facilitate easy use thereof.

Yet another object of this invention is to provide such a sizer tab which may only be installed on the hanger in one direction so as to ensure that the size indicator is properly oriented.

Still another object of this invention is to provide a sizer tab which is inexpensive to manufacture, susceptible of widespread use and is significantly improved as to its childproof features.

Other objects, advantages and features of this invention will become more apparent from the following description.

SUMMARY OF THE INVENTION

In accordance with the provisions of this invention, a sizer tab is provided having a base and a pair of upstanding arms integrally formed or molded therewith. The arms and base form an interior space. Within the interior space are located two locking fingers of different heights, oppositely disposed to each other which lock onto corresponding cross-bars provided in the hanger neck to ensure that the sizer tab cannot be removed from the hanger. This is accomplished because when one arm of the sizer tab is attempted to be lifted from the hanger, the oppositely disposed locking finger embeds itself more firmly into its corresponding cross-bar, thereby preventing the tab's removal from the hanger. Further, positioner ribs located upwardly from the base reinforce the tightness of the fit between the locking fingers and the cross-bars, further ensuring that the sizer tab cannot be removed.

Side raised barriers are formed on the neck of the hanger on either side of the tab to prevent access to the sizer tab from the sides thereof.

DETAILED DESCRIPTION

Figure 1:
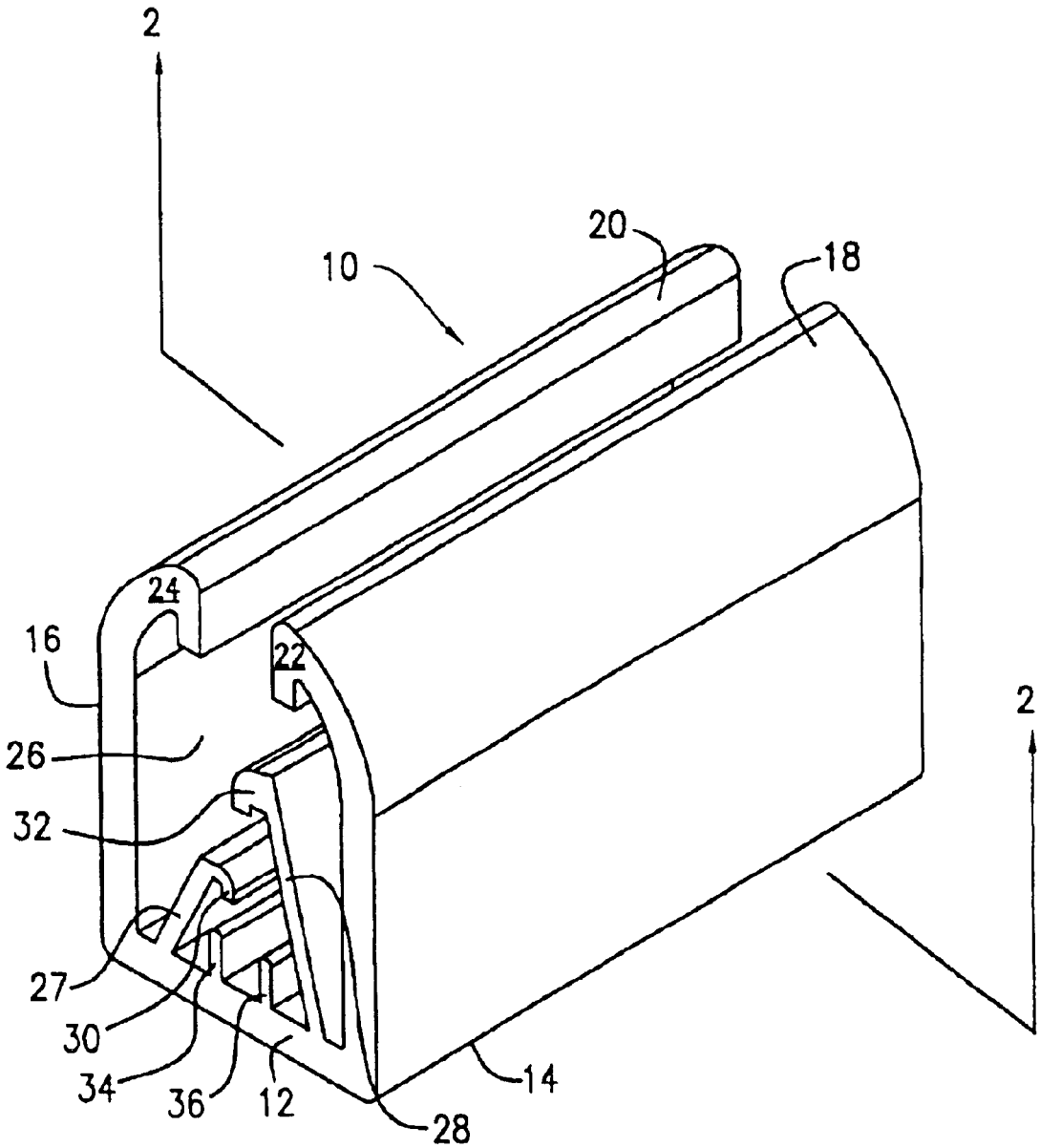
FIG. 1 is a perspective view of the sizer tab of this invention.
Figure 2:
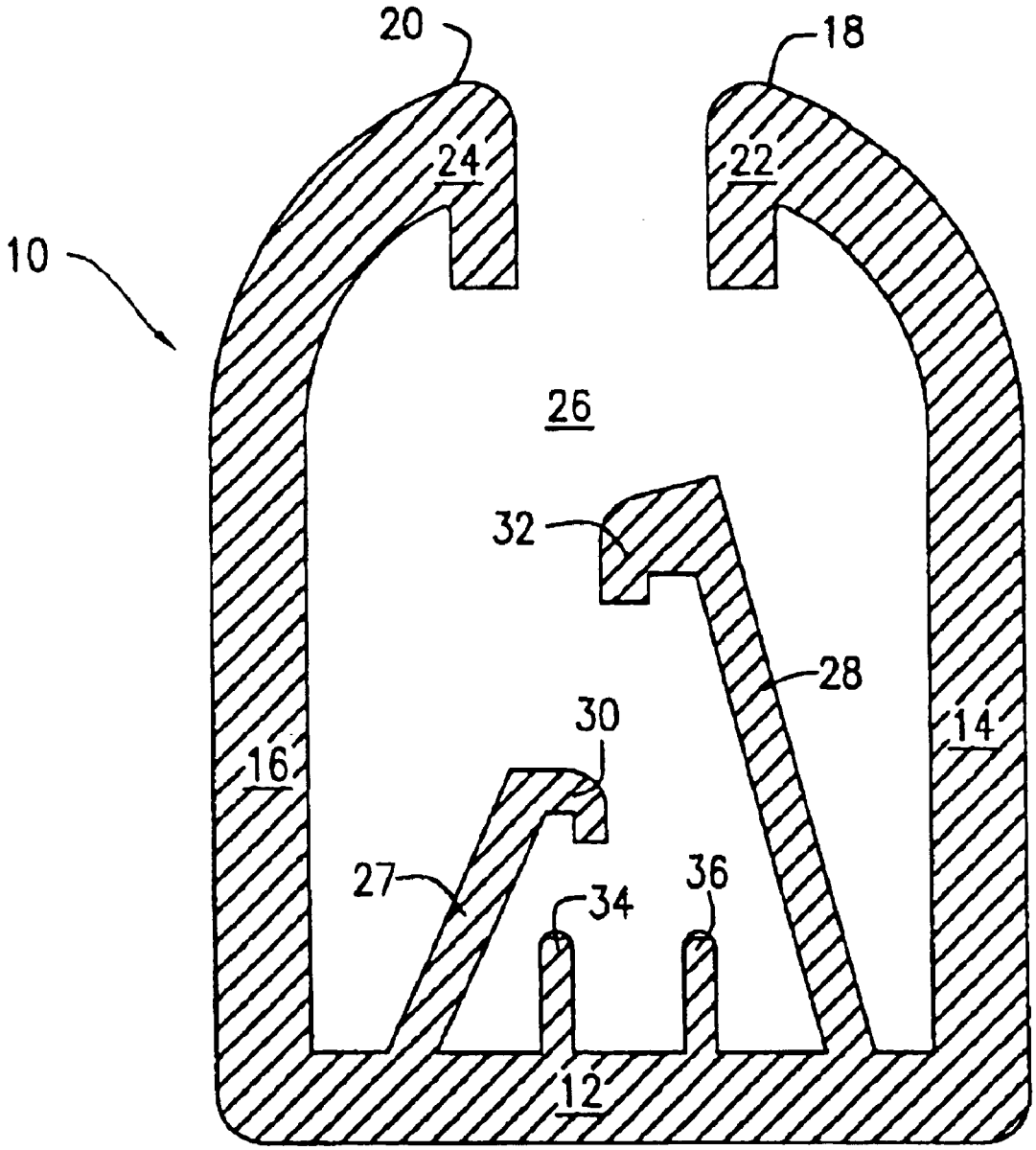
FIG. 2 is a sectional view taken along lines 2—2 of FIG. 1.

FIG. 1 is a perspective view of a sizer tab 10 which generally resembles an outdoor standard mailbox having rounded sides, a base and an interior space. The sizer tab 10 is formed of a base 12 terminating in upstanding inwardly curved sides 14 and 16 of equal length, the sides having opposite upper rounded edges 18 and 20 respectively, the upper edges terminating in short opposed lips 22 and 24 downwardly extending with a passageway formed between lips 22 and 24. These side lips are not required so long as a passageway is provided for the hanger body. Sides 14 and 16 define interior space 26. Gripping fingers 27 and 28 are integrally formed with and extend inwardly and upwardly from base 12 within the interior space 26. Gripping fingers 27 and 28 are of different lengths, with finger 27 being shorter than finger 28. Fingers 27 and 28 terminate in downwardly curved lips 30 and 32 respectively, the functions of which will be described hereinafter. The fingers 27 and 28 are resilient and flex outwardly with respect to each other at their intersection with base 12. Positioner ribs 34 and 36 extending the length of tab 10 also are integral with and extend upwardly from base 12 into the interior space 26. This invention works adequately without such positioner ribs.

Positioner ribs 34 and 36 are located approximately equally away from a longitudinal midline (not shown) formed in the base 12.

Figure 3:
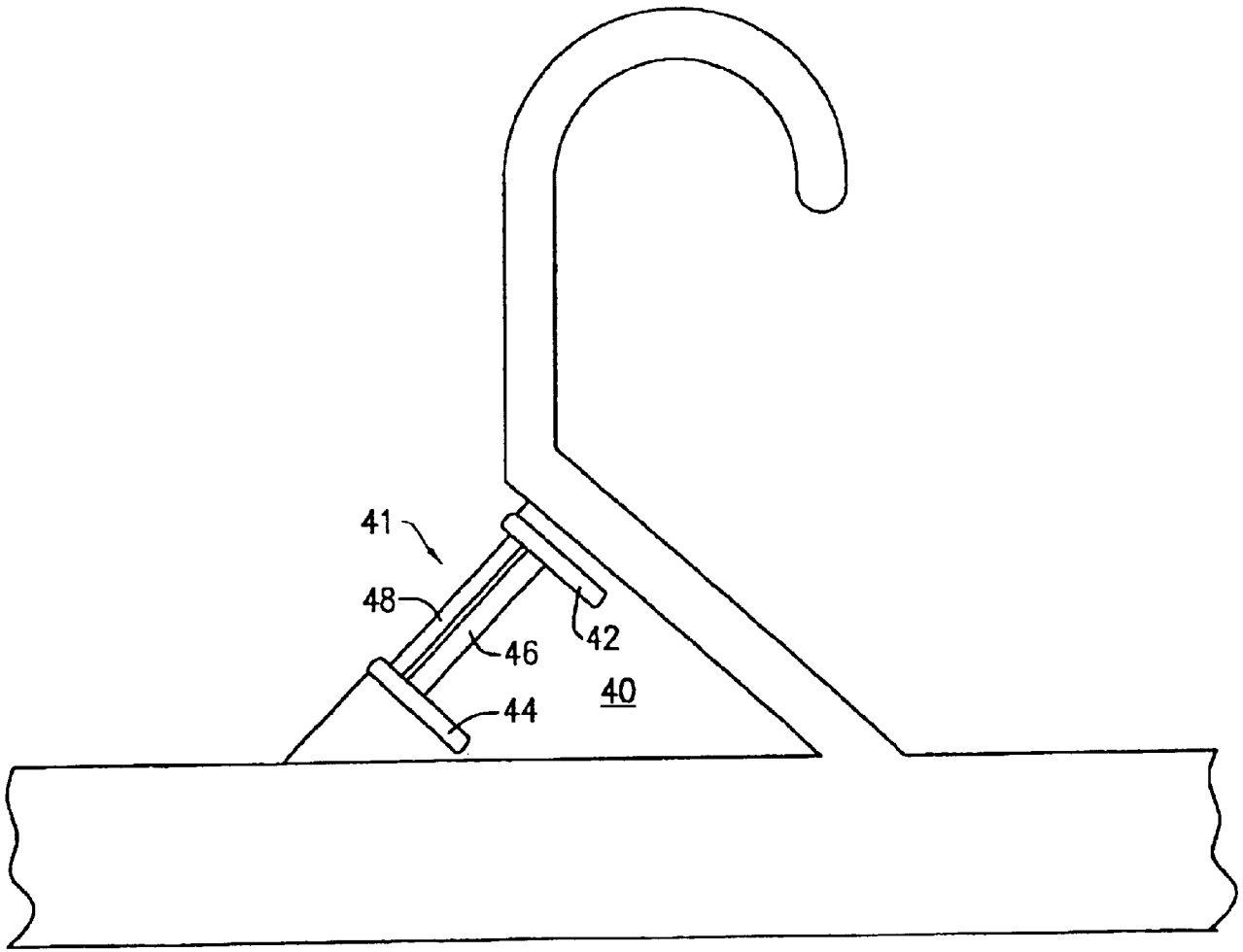
FIG. 3 is a perspective view of the portion of the neck of the hanger to which the sizer tab of FIG. 1 will attach.
Figure 4:
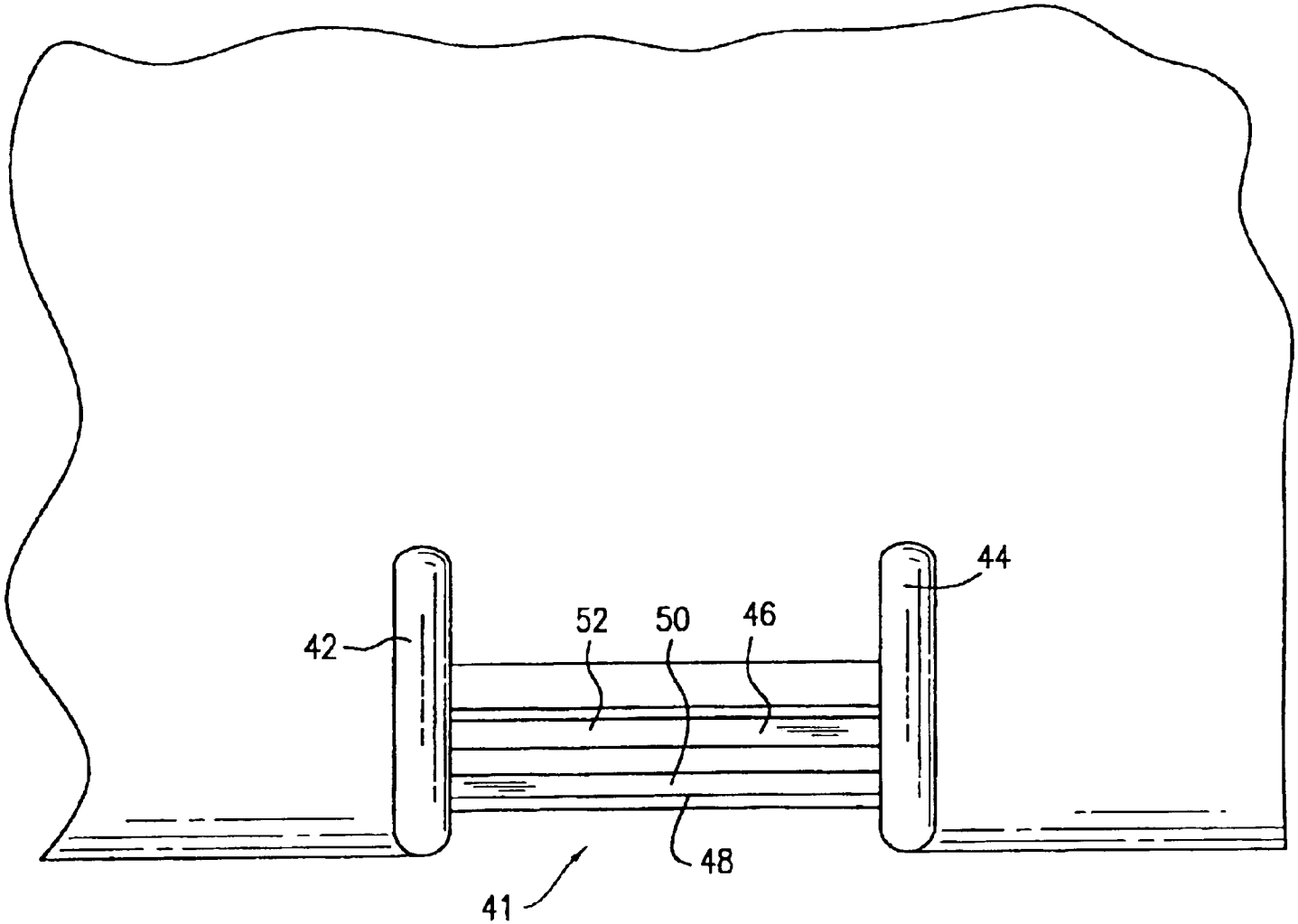
FIG. 4 is a front plan view of the neck portion of the hanger as shown in FIG. 3.

FIGS. 3 and 4 illustrate the neck portion 40 of the garment hanger, and it is understood that only that portion of the hanger need be shown in the figures. The neck portion 40 has a general upper center portion which includes a locking mechanism 41 to which the sizer attaches. The locking mechanism 41 is bounded on opposite sides by raised side barriers 42 and 44 integrally formed with the hanger neck portion 40. Parallel lower and upper cross-bars 46 and 48 are spaced apart and bridge side barriers 42 and 44 bordering an open area. Each cross-bar terminates downwardly in an opposite flange with cross-bar 46 terminating in flange 52 and cross-bar 48 terminating in flange 50 (best seen in FIG. 5).

Figure 5:
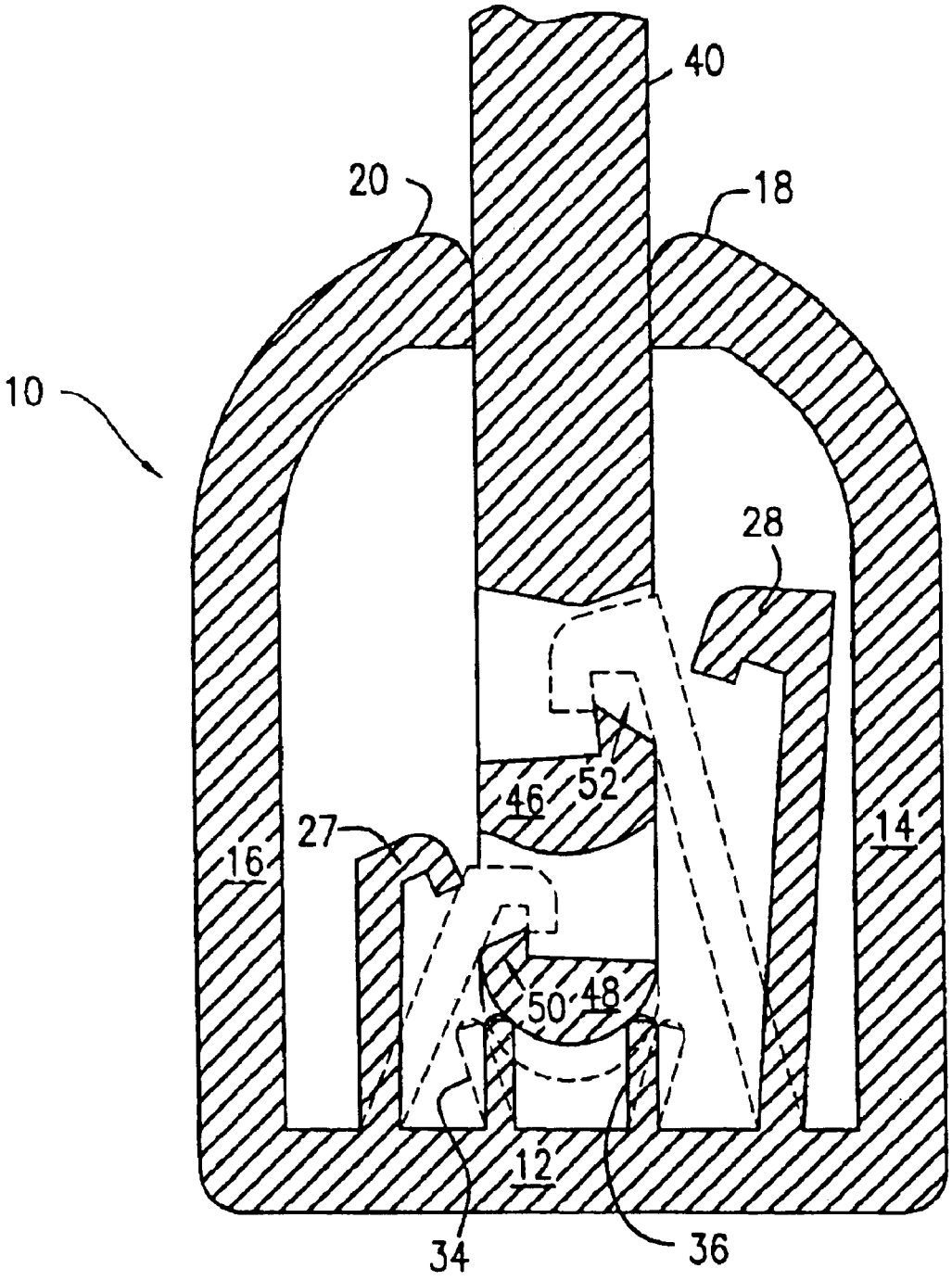
FIG. 5 is a sectional view taken generally along lines 2—2 showing the sizer tab fitting onto and locking in the neck of the hanger.

FIG. 5 illustrates the locking operation of the sizer tab. Because the sizer tab has short and long fingers 28 and 27, respectively, which lock onto respective flanges 50 and 52, it may only be slid onto and locked on the hanger neck in only one direction for secure attachment. Shorter finger 27 slides over rounded cross-bar 48 and locks over flange 50 while longer finger 28 slides over rounded cross-bar 46 and onto flange 52. As can be seen in FIG. 5, as the hanger neck 40 is inserted in sizer tab 10, the hanger cross-bars 48 and 46 force the fingers 28 and 27 to flex outwardly and then snap back to their locking positions once the hanger neck 40 is fully inserted, either by reason of holding the sizer stationary and moving the hanger therein or by sliding the sizer tab onto the hanger.

The base 12 is fairly rigid providing sufficient rigidity at the base/finger intersecting location so that the base also serves to enhance the snapping back of fingers 27 and 28 into the cross-bars 48 and 46. Positioners 34 and 36 further ensure the close fitting and interlocking nature of fingers 27 and 28 into cross-bars 48 and 46. Thus, there is no movement permitted between the locking tab and hanger once it is snapped into place onto the hanger neck. If someone were to attempt to remove the sizer tab by lifting off the front edges 18 or 20, the lifting of the front edge away from the neck of the hanger would tend to further push the opposite gripping finger into its respective flange 50 or 52. As may be seen, once the sizer tab is snapped in place, it is almost impossible to remove it by lifting either edges 18 or 20 from the hanger neck.

It should be noted in FIG. 5, the downward protrusion of lips 22 and 24 is eliminated. Further, the upper edges of lips 30 and 32 of fingers 27 and 28, respectively, are not vertically aligned and are somewhat offset one from the other so that separate and discrete mechanical forces are required to disengage fingers 27 and 28 from their locked positions.

Once the sizer tab 10 is placed on locking mechanism 41 of hanger neck portion 40, side barriers 42 and 44 block access to the sides of the tab.

The sizer tab is made of plastic and may be fabricated by molding or extruding.

It should be understood that the preferred embodiment was described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly legally and equitably entitled.

What is claimed is:

1. A locking sizer tab and garment hanger combination with the sizer tab sliding onto a neck of the hanger, said sizer tab comprising:

a base terminating in upwardly extending opposite sides, said opposite sides having respective upper edges thereof spaced apart to permit the neck of a garment hanger to pass therethrough, said neck of said garment hanger comprising a pair of spaced apart cross-bars extending across at least a portion of said neck, said opposite sides of said sizer tab defining an interior space into which the neck of the garment hanger is slid, said sizer tab comprising locking fingers extending upwardly and inwardly from the base into said interior space, each locking finger having a different respective height, said locking fingers terminating in lips which hook onto respective ones of said cross-bars, said locking fingers being flexible so as to be flexed outwardly as the garment hanger slides into the interior space of said sizer tab, with said locking fingers thereafter snapping back into locking positions with respective ones of said cross-bars.

2. A locking sizer tab and garment hanger combination in accordance with claim 1, wherein said cross-bars are parallel to each other.

3. A locking sizer tab and garment hanger combination in accordance with claim 2, wherein said cross-bars comprise round edges facing the direction in which the garment hanger slides onto the sizer tabs thereby facilitating said locking fingers sliding over and snapping onto said cross-bars.

4. A locking sizer tab and garment hanger combination in accordance with claim 3, wherein each cross-bar comprises a respective flange at its upper edge thereof, said respective finger being flexed outwardly and being snapped back so that each respective lip locks into engagement with respective flanges of said cross-bars.

5. A locking sizer tab and garment hanger combination in accordance with claim 1, wherein the lips of said looking fingers are offset vertically with respect to each other.

6. A locking sizer tab and garment hanger combination in accordance with claim 1, further comprising side barriers bordering said cross-bars and preventing access to the edges of said locking sizer tab when said locking sizer tab is disposed on said neck.

7. A locking sizer tab and garment hanger combination in accordance with claim 1, wherein said opposite sides are of equal height.

8. A locking sizer tab and garment hanger combination in accordance with claim 1, wherein said sizer tab comprises a molded plastic piece.

9. A locking sizer tab and garment hanger combination in accordance with claim 7, wherein said opposite sides terminate in downwardly oriented lips of equal length to further define a passage to said interior space of said sizer tab.

10. A locking sizer tab and garment hanger combination in accordance with claim 1, wherein said sizer tab comprises an extruded plastic piece.

* * * * *